US005754003A

United States Patent [19]

Murai et al.

[11] Patent Number: 5,754,003

[45] Date of Patent: May 19, 1998

[54] DISCHARGER DISPLAY DEVICE HAVING MEANS FOR AIR-TIGHT SEPARATION OF DISCHARGE CHAMBERS BY PARTITION WALLS, AND PROCESS OF PRODUCING THE SAME

[75] Inventors: Hirotaka Murai, Miwamachi; Shigeo Mori, Amagi; Susumu Sakamoto, Dazaifu, all of Japan

[73] Assignees: Noritake Co., Limited, Nagoya; Kyushu Noritake Co., Ltd., Asakura-Gun, both of Japan

[21] Appl. No.: 577,531

[22] Filed: Dec. 22, 1995

[30] Foreign Application Priority Data

Dec. 28, 1994 [JP] Japan ..... 6-326517

[51] Int. Cl.[6] ..... H01J 17/49

[52] U.S. Cl. ..... 313/582; 445/25; 313/634; 345/60

[58] Field of Search ..... 445/24, 25; 313/309, 313/582, 634; 345/60

[56] References Cited

U.S. PATENT DOCUMENTS 3,939,556 2/1976 Borel et al. ..... 445/25
5,408,245 4/1995 Kakizaki ..... 345/60
5,670,843 9/1997 Matsuura ..... 445/25

FOREIGN PATENT DOCUMENTS 5-151901 6/1993 Japan .
6-102834 4/1994 Japan .
6-208109 7/1994 Japan .

*Primary Examiner*—Kenneth J. Ramsey
*Attorney, Agent, or Firm*—Oliff & Berridge, PLC

[57] ABSTRACT

A discharge display device wherein a gas-tight space defined by two plates and a sealing member is divided into a plurality of discharge chambers by partition walls formed on one of the two plates, and height adjusting layers are interposed between end faces of the respective partition walls and an inner surface of the other plate. Each height adjusting layer is formed from a material which has a softening point not lower than that of the sealing member and which is softened at a sealing temperature at which the two plates are bonded together by the sealing member. The height adjusting layers, which assure gas-tight separation of the discharge chambers, may replace upper end portions of the partition walls. Alternatively, the partition walls may be entirely formed from the above-indicated material. Also disclosed is a process of fabricating such a discharge display device, wherein height adjusting layers are softened at the sealing temperature when the two plates are bonded together with the melting of the sealing member.

16 Claims, 6 Drawing Sheets

FIG. 3 (a)-1
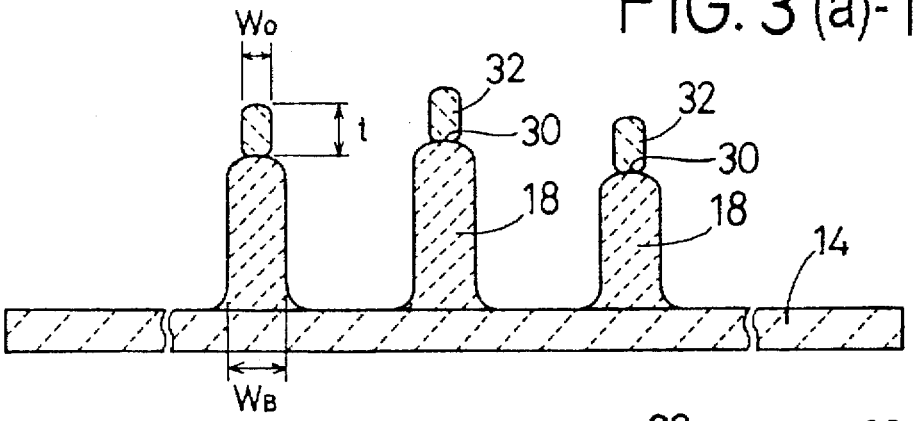
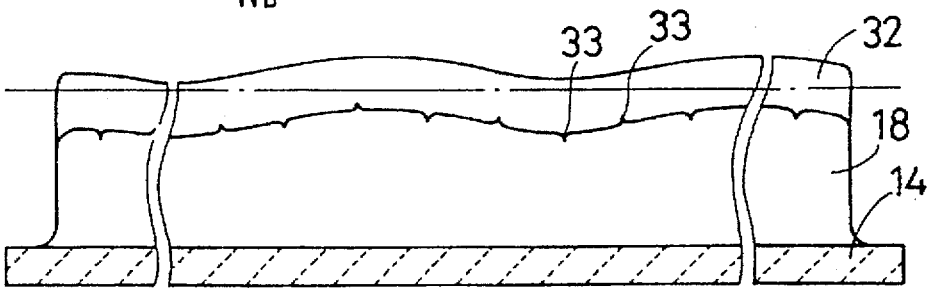
FIG. 3 (a)-2
FIG. 3 (b)
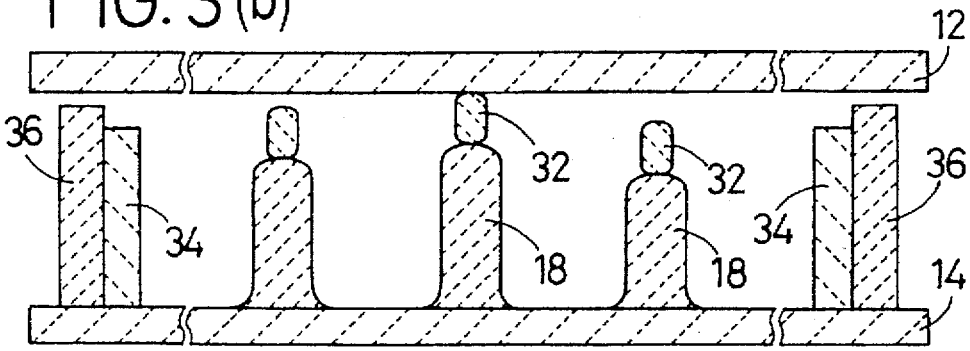
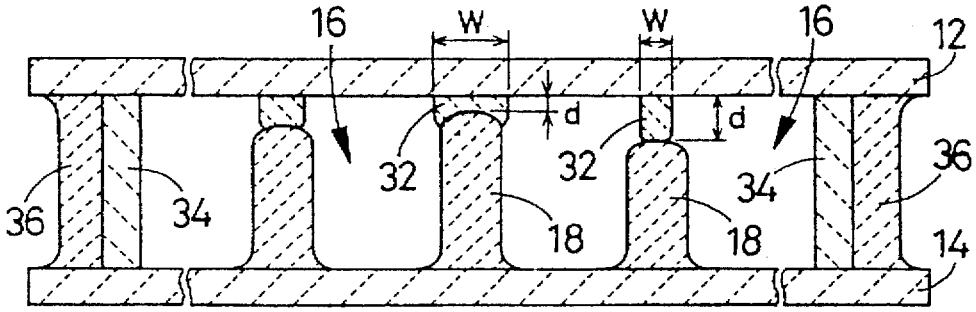
FIG. 3 (c)

DISCHARGER DISPLAY DEVICE HAVING MEANS FOR AIR-TIGHT SEPARATION OF DISCHARGE CHAMBERS BY PARTITION WALLS, AND PROCESS OF PRODUCING THE SAME

BACKGROUND OF THE INVENTION

1. Field of the Invention

The present invention relates to a discharge device utilizing a gas discharge, such as a plasma display device or a plasma address liquid crystal display device, and more particularly to arrangements of partition walls which partially define gas-tight discharge chambers filled with a gas.

2. Discussion of the Related Art

There is known a discharge display device including a first plate and a second plate which are spaced apart from each other in parallel relation with each other, a sealing member for air-tightly bonding together the first and second plates at their peripheral portions at a predetermined sealing temperature so as to form a gas-tight space, and a plurality of partition walls which are formed on one of the first and second plates, more precisely, on one of opposite surfaces of the first and second plates, so as to divide the gas-tight space into a plurality of discharge chambers which are filled with a gas. Such discharge display device is adapted to display desired images such as letters, symbols and other characters or graphical representations, utilizing electric discharges within selected ones of the discharge chambers. Examples of such discharge display devices include a plasma display panel (abbreviated as "PDP") and a plasma address liquid crystal display panel (abbreviated as "PALC") as disclosed in JP-A-6-102834. Such discharge display devices are relatively easier to manufacture in a panel or plate form with a comparatively small thickness, and are therefore considered to be an image display device which replaces a cathode ray tube.

The plasma display panel (PDP) is provided with a plurality of discharge electrodes for inducing electric discharge in selected ones of the discharge chambers, so that plasma generated by the electric discharge causes emission of orange light from a neon gas in the selected discharge chambers to thereby form an image, or generation of a ultraviolet radiation which in turn excites a fluorescent material to emit a visible light in the selected discharge chambers to thereby form an image.

The plasma address liquid crystal display panel (PALC) is an example of a liquid crystal display (abbreviated as "LCD") of active matrix drive type which is excellent in image response speed and contrast. Generally, TFT (thin-film transistor) drive is employed as the active matrix drive. However, the TFT drive requires a multiplicity of nonlinear elements (transistors) corresponding to the picture elements, which non-linear elements should be formed by a thin-film forming technique. In the light of difficulty to fabricate the TFT drive liquid crystal display of a large size, the plasma address liquid crystal display panel is proposed as a large-sized LCD alternative to the TFT drive LCD. In this PALC display panel, both of the first and second plates are formed of a light-transmitting or translucent material, and elongate parallel partition walls are formed on one of the first and second plates, so as to define a plurality of elongate parallel discharge chambers, while the other plate consists of a dielectric layer having a comparatively small thickness (e.g., about 50 μm-thick glass plate). The PALC display panel further includes a plurality of discharge electrodes formed in parallel to the partition walls, for inducing electric discharge within the discharge chambers, and a third plate disposed on one of opposite sides of the above-indicated other plate (dielectric layer) which is remote from the discharge chambers. The third plate is provided with a plurality of parallel transparent electrodes which extend in a direction perpendicular to the direction of extension of the discharge electrodes and are formed of an indium oxide or tin oxide (ITO). The third plate may be further provided with a color filter. The PALC display panel has a liquid crystal layer between the dielectric layer (one of the first and second plates) and the third plate indicated above.

When an electric discharge occurs between a selected pair of discharge electrodes in the PALC display panel, plasma is generated in the discharge chamber associated with the energized discharge electrodes, and an area of the dielectric layer which partially define the discharge chamber in question is given a substantially uniform electric potential. Upon application of a predetermined voltage between a selected pair of transparent electrodes in the above condition, an electric charge is stored or accumulated at a local spot of the dielectric layer at an intersection of the energized pair of discharge electrodes and the energized pair of transparent electrodes. As a result, the molecules in the corresponding area of the liquid crystal layer are orderly arranged or oriented. This liquid crystal orientation is maintained even after the extinction of the plasma, owing to a memory effect of the electric charge. Thus, in the PALC display panel, the discharge chambers, discharge electrodes and dielectric layer cooperate to provide plasma switches which function as the TFT, and the partition walls and the discharge electrodes may be easily formed on one of the first and second plates, which is not the dielectric layer. Accordingly, the PALC display panel may be comparatively easily fabricated with a relatively large image screen without significant flaws, as compared with the TFTLCD display panel having multiple nonlinear elements corresponding to the picture elements.

In the PDP or PALC display panels, the partition walls are formed on one or both of the first and second plates (generally formed on one of these plates, for increased production efficiency), by a thick-film screen printing technique using a suitable printing paste. However, the partition walls tend to have different height dimensions due to warpage or waviness of the appropriate plate, and a thickness variation in the constituent green layers which are formed by repeated screen printing operations for each partition wall. Further, the partition walls may have burrs on their top faces, due to the use of screen meshes for the screen printing. On the other hand, the other plate may also have some warpage or waviness and a relatively low degree or flatness or straightness. The height variation of the partition walls formed on one of the two plates and the poor flatness of the other plate cause gaps to be left between the end faces of the partition walls and the corresponding surface of the above-indicated other plate, after the two plates are bonded together at their peripheral portions so as to form a gas-tight space which are divided by the partition walls into the discharge chambers. In the PALC display panel wherein the other plate has a relatively small thickness, this plate is easily deformed following the varying height of each partition walls and the different heights of the individual partition walls. Accordingly, the other plate tends to have deteriorated flatness in the end product. This problem is particularly serious where the partition walls are formed on both of the first and second plates and the end faces of the opposed partition walls are held in contact with each other, as disclosed in JP-A-5-151901.

The known discharge display devices suffer from the following problems due to the gaps between the partition walls and the above-indicated other plate and poor flatness of this plate:

(1) In the plasma display panel, the individual discharge chambers are not sufficiently gas-tightly separated by the partition walls, or communicate with each through the above-indicated gaps, whereby the display panel suffers from so-called "cross talks", that is, an electric discharge undesirably occurs in the discharge chambers adjacent to the selected discharge chambers in which an electric discharge should occur for imaging.

(2) In the color plasma display panel, the ultraviolet radiation generated by an electric discharge caused by the above-indicated cross talk propagates into the adjacent discharge chambers, causing erroneous excitation of the fluorescent materials in these adjacent discharge chambers, and resulting in undesirable color mixing.

(3) In an AC-type surface emitting plasma display panel wherein electric discharge occurs only in the discharge chambers whose walls are electrically charged by the energized discharge electrodes on the above-indicated other plate, the individual discharge chambers should be electrically insulated from each other by the partition walls so as to assure uniform electric charge over the entire gas-tight space. That is, it is desirable in driving the display panel, to increase the difference between voltages for turning on and off the picture element cell, for obtaining a large "memory margin". This memory margin relates to the area of contact between the end faces of the partition walls and the transparent electrodes provided on the above-indicated other plate. The burrs on the end faces of the partition walls reduces the memory margin.

(4) In the plasma address liquid crystal display panel wherein the liquid crystal layer is formed between the relatively thin dielectric layer (other plate) and the third plate, poor flatness of the dielectric layer causes a thickness variation of the liquid crystal layer, leading to deteriorated consistency in image reproduction. Further, the height variation of the partition walls influences the discharge chambers adjacent to the discharge chambers in which the gas is ionized, namely, in which the plasma switch is on. Described in detail, the ionization of the gas causes electric charge to be moved in the presence of an electric field produced by the transparent electrodes, whereby the plasma cooperates with the discharge electrodes (as data electrodes) and an anode (having the ground potential of the discharge chamber) to constitute an electric circuit, and the electric charge is accumulated on the lower surface of the dielectric layer. Consequently, the above-indicated gaps cause the electric charge to influence the discharge chambers adjacent to the discharge chambers in which the gas is ionized (in which the plasma switch is on). Further, the burrs on the end faces of the partition walls may damage the thin dielectric layer.

In the conventional fabrication of the discharge display devices, the following measures are employed in an effort to reduce the drawbacks due to the height variation of the partition walls:

(a) The end faces of the partition walls are ground or otherwise made flat to eliminate burrs and waviness, as disclosed in JP-A-6-208109.

(b) A pressure is applied to the first and second plates upon bonding thereof, to assure gas tightness therebetween.

In Japanese patent application No. 6-264746 (which has not been published at a time the present invention was made), it is proposed to cover the partition walls at their end faces with a paste applied by printing, which paste has a high ability to be formed flat and includes a powder of an organic material whose particle size is controlled to be relatively small.

However, the above measures increase the number of steps to be performed in the fabrication process, and the complexity of the process. Further, those measures do not have a similar effect over the entire area of the display panel when the panel is relatively large. The measure (a) requires the use of a specific material for the partition walls, so that the partition walls are not damaged by the grinding operation, and requires an additional step of removing a swarf produced by the grinding. Although the measure (b) solves the problem of the gaps otherwise left between the partition walls and the appropriate plate, it does not solve the problem which arises from the presence of burrs on the end faces of the partition walls. In the PALC display panel, the measure (b) does not solve the problem of poor flatness of the appropriate plate. In the PDP display panel, the measure (b) is not sufficiently effective to assure gas tightness between the discharge chambers and uniformity of the electric discharge. Further, the heat capacity of a jig for applying a pressure to the plates should be taken into account when the plates are bonded together at a predetermined heat treatment or sealing temperature. The measure (c) is effective to reduce the problem due to the relatively small burrs on the end faces of the partition walls, but is not effective to solve the problem of the poor flatness of the plate due to the warpage and height variation of the partition walls.

SUMMARY OF THE INVENTION

It is therefore a first object to provide a discharge display device which is easier to fabricate and which are less likely to suffer from gaps left between the partition walls on one of the first and second plates and the other plate, due to the height variation of the partition walls and poor flatness of the plates, and deterioration of the above-indicated other plate.

It is a second object to provide a process suitable for fabricating such a discharge display device with high efficiency.

The first object may be achieved according to one aspect of the present invention, which provides a discharge display device comprising: (a) a first plate and a second plate which are disposed in parallel with each other and are spaced apart from each other; (b) a sealing member which is disposed between peripheral portions of the first and second plates and which cooperates with the first and second plates to form a gas-tight space; (c) a plurality of partition walls formed on an inner surface of one of the first and second plates, so as to define a plurality of discharge chambers in the gas-tight space; and (d) a plurality of height adjusting layers which are interposed between end faces of the partition walls, respectively, and an surface of the other of the first and second partition walls, which inner surface is opposed to the inner surface of the above-indicated one plate. Each of the height adjusting layers is formed from a material which has a softening point not lower than that of the sealing member and which is softened at a sealing temperature at which the first and second plates are bonded together by the sealing member so as to form the gas-tight space. The height adjusting layers have respective thickness values which increase with a decrease in a distance between the end faces of the partition walls and the inner surface of the above-indicated other plate, so that the height adjusting layers assure gas-tight separation of the discharge chambers from each other, without gaps being left between the end faces of the partition walls and the inner surface of the above-indicated other plate.

The second object may be achieved according to a second aspect of this invention. That is, the discharge display device according to the first aspect of the invention may be suitably fabricated according to the second aspect of the invention, which provides a process of fabricating a discharge display device as defined described above, the process comprising the steps of: (i) forming said plurality of partition walls on the inner surface of the above-indicated one of the first and second plates; (ii) forming masses of a paste of the above-indicated material on the end faces of the partition walls, respectively; (iii) placing the sealing member on the peripheral portion of the above-indicated one of the first and second plates, such that the sealing member has a height larger than that of a highest one of the partition walls; (iv) placing the the other of the first and second plates on an assembly of the above-indicated one plate, the partition walls, the sealing member and the masses of the above-indicated paste, such that the above-indicated other plate is supported by at least one of the sealing member and the masses of the paste; and (v) heat-treating the assembly and the other plate such that the sealing member is melted while the masses of the paste are softened, for thereby bonding together the first and second plates by the sealing member, and for permitting the masses of the paste to be deformed between the inner surface of the other plate and the end faces of the partition walls, so as to form the height adjusting layers, respectively.

In the discharge display device of the present invention constructed and fabricated as described above, the spaces between the end faces of the partition walls and the inner surface of the above-indicated other plate are gas-tightly filled with the height adjusting layers formed by heat-treating the respective masses of the paste of a material whose softening point is not lower than that of the sealing member and which is softened at the heat treatment or sealing temperature at which the sealing member is melted for bonding of the first and second plates so as to form the gas-tight space. The masses of the paste which give the height adjusting layers are softened at the sealing temperature and are deformed by squeezing forces due to the weight of the above-indicated other plate, which squeezing forces increase with a decrease in a distance between the end faces of the partition walls and the inner surface of the above-indicated other plate. This distance varies due to the height variation of the partition walls and warpage or waviness of the above-indicated other plate. Thus, the thickness values of the height adjusting layers which are formed from the paste masses and which have been deformed by the squeezing forces increase with a decrease in the above distance, so that the spaces between the end faces of the partition wall and the inner surface of the above-indicated other plate are filled with the height adjusting layers formed by heat treatment of the paste masses at the sealing or heat treatment temperature. In this respect, it is noted that the paste masses for the height adjusting layers are only softened but not melted at the sealing temperature, that is, at the melting point of the sealing member. Accordingly, the paste masses for the height adjusting layers are deformed so that the formed height adjusting layers just fill the spaces between the end faces of the partition walls and the above-indicated other plate, without gaps being created therebetween due to flow or droop of the paste which would occur if the paste was melted at the sealing temperature.

In the present discharge display device, there are left no gaps between the end faces of the partition walls and the height adjusting layers, and between the height adjusting layers and the inner surface of the above-indicated other plate, even if the individual partition walls have different height dimensions and the first and/or second plates have some amounts of warpage or waviness. Accordingly, the discharge chambers are air-tightly separated from each other by the partition walls and the height adjusting layers, without complicated process steps in the fabrication of the display device. In the heat treatment or sealing step in which the first and second plates are bonded together by the sealing member melted at the sealing temperature, the masses of the paste for the height adjusting layers are softened and deformed so that the thickness values of the height adjusting layers in the fabricated display device are comparatively small where the above-indicated distances are comparatively large, while the thickness values are comparatively large where the distances are comparatively small. Therefore, the sum of the height of each partition wall and the thickness of the corresponding height adjusting layer is substantially constant over the entire area of the first and second plates, whereby the above-indicated other plate is protected from warping due to the height variation of the partition walls, even if that plate has a comparatively small thickness as in a plasma address liquid crystal (PALC) display panel. Where the softening point of the material of the height adjusting layers is substantially the same as that of the sealing member, it is desirable that the paste for the height adjusting layers include a suitable amount of a suitable filler such as alumina particles or glass beads, for restricting a tendency of deformation of the height adjusting layers by their own weights at the sealing temperature, so as to improve the ability of shape retention of the paste in the sealing step.

Further, the provision of the height adjusting layers for compensation for the height variation of the partition walls favorably reduces the requirements for stringent shape retention and accurate thickness control of green laminar masses by thick-film screen printing to give the partition walls, thereby permitting a higher degree of freedom in material selection and process step parameters (e.g., number of repeated screen printing operations) of the partition walls. In addition, the height adjusting layers assures high gas tightness between the partition walls and the above-indicated other plate even where the discharge display device has a comparatively large display screen.

The discharge display device according to the first aspect of the invention may also be suitably fabricated according to a third aspect of this invention, which provides a process of fabricating a discharge display device constructed as described above, the process comprising the steps of: (i) forming the plurality of partition walls on the inner surface of the above-indicated one of the first and second plates; (ii) forming a layer of a paste of the above-indicated material on the inner surface of the other plate; (iii) placing the sealing member on the peripheral portion of the above-indicated one plate, such that the sealing member has a height larger than that of a highest one of the partition walls; (iv) placing the other plate with the layer of the paste on an assembly of the above-indicated one plate, the partition walls and the sealing member, such that the layer of the paste is in contact with at least one of the sealing member and the end faces of the partition walls; and (v) heat-treating the assembly and the other plate with the layer of the paste such that the sealing member is melted while the layer of the paste is softened, for thereby bonding together the first and second plates by the sealing member, and for permitting the layer of the paste to be deformed between the inner surface of the other plate and the end faces of the partition walls, so as to form the height adjusting layers, respectively.

The term "softening" is interpreted to mean a state of a non-crystalline material such as a glass material in which the material is easily deformed by a stress, with a plastic flow of the material occurring at an elevated temperature. The softening is a phenomenon which takes place prior to melting. Generally, the "softening point" of a glass material is a point at which the viscosity is $4.5\times10^7$ P ($4.5\times10^6$ Pa.s). For ceramic materials, the softening point is usually considered to be a temperature at which apparent thermal expansion of the material stops due to softening during measurement of the coefficient of thermal expansion, namely, a temperature at which the thermal expansion is the largest. Different ceramic materials have almost similar relationships between the softening and melting points, if these points are measured by similar methods.

The first object may also be achieved according to a fourth aspect of this invention, which provides a discharge display device comprising: (a) a first plate and a second plate which are disposed in parallel with each other and are spaced apart from each other; (b) a sealing member which is disposed between peripheral portions of the first and second plates and which cooperates with the first and second plates to form a gas-tight space; and (c) a plurality of partition walls formed on an inner surface of one of the first and second plates, so as to divide the gas-tight space into a plurality of discharge chambers. At least an end portion of each of the partition walls remote from the above-indicated one of the first and second plates is formed from a material which has a softening point higher than that of the sealing member and which is softened at a sealing temperature at which the first and second plates are bonded together by the sealing member so as to form said gas-tight space. The partition walls assure gas-tight separation of the discharge chambers from each other, without gaps being left between the end faces of the partition walls and the inner surface of the other of said first and second plates.

The second object may also be achieved according to a fifth aspect of the invention. That is, the discharge display device according to the fourth aspect of the invention a process of fabricating a discharge display device constructed according to the fourth aspect of the invention, the process comprising the steps of: (i) forming masses of at least one paste on the inner surface of the above-indicated one of the first and second plates, the masses of the paste giving the plurality of partition walls when the masses are heat-treated, the at least one paste including a paste of the above-indicated material of which an end portion of each of the masses is formed; (ii) placing the sealing member on the peripheral portion of the above-indicated one plate; (iii) placing the other plate on an assembly of the above-indicted one plate, the masses of the at least one paste and the sealing member, such that the other plate is supported by at least one of the sealing member and the masses of the at least one paste; and (iv) heat-treating the assembly and the other plate such that the sealing member is melted while the end portion of the each mass which is formed of the paste of the above-indicated material is softened, for thereby bonding together the first and second plates by the sealing member, and for permitting at least the end portion of each of the masses to be deformed into the end portion of each partition wall.

In the discharge display device constructed according to the fifth aspect of this invention as described above, at least the end portion of each paste mass for the partition walls is formed of a material whose softening point is higher than that of the sealing member and which is softened at the heat treatment or sealing temperature at which the sealing member is melted upon bonding of the first and second plates so as to form the gas-tight space. The end portion of each paste mass for each partition wall is softened at the heat treatment temperature and deformed by a squeezing force due to the weight of the above-indicated other plate, which squeezing force is determined by the original height variation of the paste masses for the partition walls and by warpage or waviness of the above-indicated other plate. Thus, the end portions of the paste masses which are only softened but not melted at the heat treatment or sealing temperature are deformed to have respective height dimensions so that no gaps are left between the end faces of the eventually formed partition walls and the inner surface of the above-indicated other plate, whereby the discharge chambers are gas-tightly separated from each other by the partition walls, without complicated process steps in the fabrication of the display device. Further, owing to the deformation of at least the end portions of the paste masses for the partition walls in the direction of height in the heat treatment or sealing step, the above-indicated other plate is protected from warping due to the height variation of the partition walls, even if that plate has a comparatively small thickness as in a plasma address liquid crystal (PALC) display panel.

In the present discharge display device, the partition walls whose end portions are formed from the material which is softened and deformed at the sealing temperature so as to compensate for the original height variation are effective to reduces the requirements for stringent shape retention and accurate thickness control of the laminar paste masses by thick-film screen printing for the partition walls, thereby permitting a higher degree of freedom in material selection and process step parameters (e.g., number of repeated screen printing operations) of the partition walls. In addition, the present partition walls assure high gas tightness with respect to the above-indicated other plate even where the discharge display device has a comparatively large display screen.

Each of the masses which give the partition walls is entirely formed of the paste of the above-indicated material.

BRIEF DESCRIPTION OF THE DRAWINGS

The above and optional objects, features, advantages and technical and industrial significance of the present invention will be better understood by reading the following detailed description of presently preferred embodiments of the invention, when considered in connection with the accompanying drawings, in which:

FIG. 3 are views for explaining a process of fabricating the display panel of FIG. 1, wherein FIG. 3(*a*)-1 is a cross sectional view corresponding to that of FIG. 2, showing the partition walls and height adjusting layers formed on the partition walls;

FIG. 3(*a*)-2 is a cross sectional view taken in a plane parallel to the partition walls, FIG. 3(*b*) is a cross sectional view showing a process step following the step of FIG. 3(*a*)-1, wherein a front glass plate is placed on the partition walls via the height adjusting layers, and FIG. 3(*c*) is a cross sectional view showing the front glass plate bonded to the partition walls via the height adjusting layers;

DETAILED DESCRIPTION OF THE PREFERRED EMBODIMENTS

Figure 1:
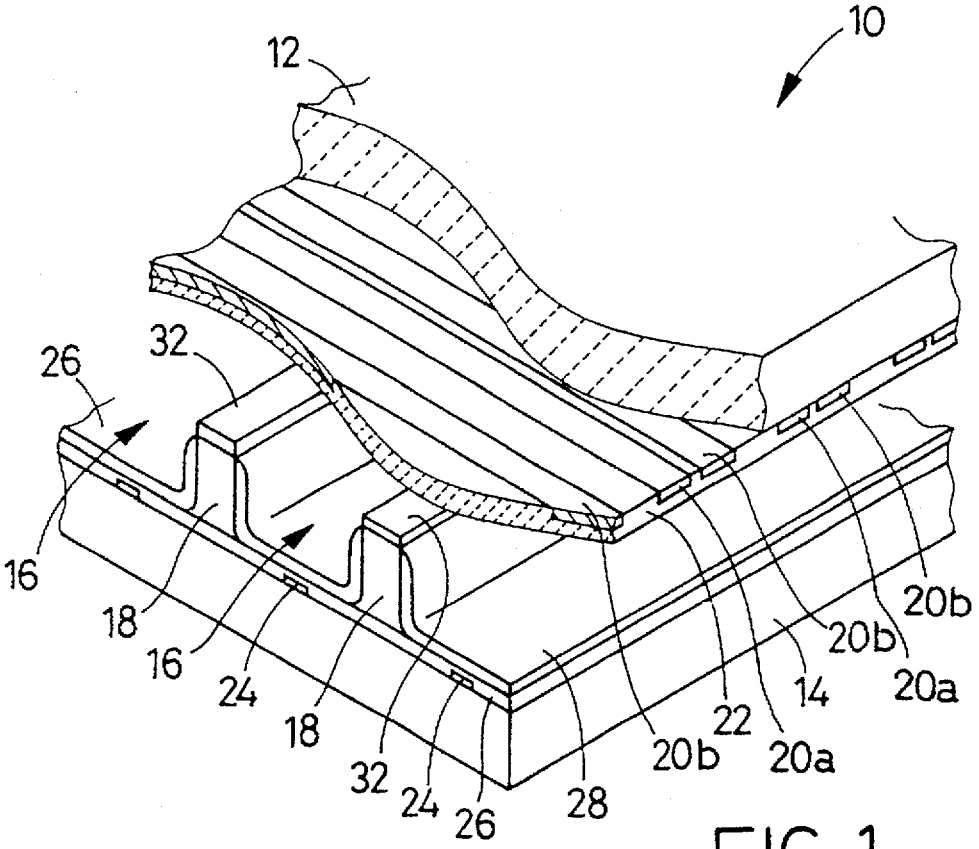
FIG. 1 is a fragmentary perspective view partly in cross section of one embodiment of this invention in the form of an AC-type color plasma display panel.

Referring to the accompanying drawings showing the preferred embodiments, it is to be understood that the relative dimensions of the various components as shown in the drawings do not reflect actual articles of manufacture, and that the components as shown are dimensioned for easy understanding of the present invention.

Referring first to FIG. 1 schematically illustrating a discharge display device in the form of an AC-type color plasma display pane (PDP) 10 constructed according to one embodiment of this invention, the color plasma display panel 10 includes a translucent or light-transmitting front glass plate 12, a back plate 14, and a plurality of elongate parallel partition walls 18 which are formed so as to define a plurality of parallel discharge chambers 16 between the front and back plates 12, 14. Each of the front and back plates 12, 14 may consist of a glass sheet, for example. The partition walls 18 are formed such that the spacing between the adjacent partition walls 18 (i.e., a width of each discharge chambers 16) is in a range of about 0.2–0.5 mm, for example, while the partition walls 18 have a height dimension within a range of about 0.1–0.2 mm, for example.

On an inner surface of the front plate 12 which is located on the side of the back plate 14, there are formed a plurality of elongate parallel discharge electrodes (display electrodes) 20 such that these discharge electrodes 20 extend in a direction perpendicular to the direction of extension of the partition walls 18. An array of the discharge electrodes 20 is covered by a transparent dielectric layer 22. The discharge electrodes 20 are formed by a thin-film photolithographic technique, using an indium or tin oxide (ITO), for instance, such that the spacing between the two adjacent electrodes 20*a*, 20*b* of each pair is in a range of about 50–100 μm and such that a center-to-center distance of the pair 20*a*, 20*b* is in a range of about 0.6–1.5 mm. The dielectric layer 22 is formed by a thick-film screen printing technique, using a glass which has a relatively low softening point or temperature. The dielectric layer 22 has an effective thickness of about 20–60 μm as measured at its portions corresponding to the width of each discharge electrode 22.

On an inner surface of the back plate 14 on the side of the front plate 12, there are formed a plurality of elongate parallel address electrodes 24 such that the address electrodes 24 extend in parallel with the parallel partition walls 18 and such that each address electrode 24 is located between the corresponding two adjacent partition walls 18. Namely, the address electrodes 24 are perpendicular to the discharge electrodes 20, and the spacing between the adjacent address electrodes 24 is equal to the spacing between the adjacent partition walls 18. The discharge electrodes 20 and the address electrodes 24 cooperate to define a matrix in which the intersections of these electrodes 20, 24 are spaced apart from each other at a pitch which is one third of the pitch of a matrix of picture elements. The pitch of the above-indicated intersections is equal to the pitch of color cells R (red), G (green) and B (blue). That is, the pitch of the color cells is one third of the pitch of the picture elements. Therefore, one picture element is defined by a total of nine color cells, which consist of three red-color cells corresponding to one red-color discharge chamber 16, three green-color cells corresponding to one green-color discharge chamber 16 adjacent to the red-color discharge chamber 16, and three blue-color cells corresponding to one blue-color discharge chamber 16 adjacent to the green-color discharge chamber 16.

The address electrodes 24 have a width of about 0.05–0.5 mm, and a thickness of about 3–20 μm, and is formed by a thick-film screen printing technique, using a paste of silver (Ag), for example. Alternatively, the address electrodes 24 may be formed by first forming a thick film by a thick-film forming technique and then etching the thus formed thick film to form a pattern of the address electrodes by photolithography. The spacing between the adjacent address electrodes 24 is in a range of about 0.2–0.5 mm.

Like the dielectric layer 22, the dielectric layer 26 is formed by a thick-film screen printing technique using a glass having a relatively low softening point. The dielectric layer 26 has an effective thickness of about 5–30 μm as measured at its portions corresponding to the width of each address electrode 24.

In the present embodiment, the back plate 14 provided with the dielectric layer 26 functions as one of a first and a second plate which partially define a fluid-tight space, while the front plate 12 provided with the dielectric layer 22 functions as the other of the first and second plates. More specifically explained, the partition walls 18 are provided on the above-indicated one of the first and second plates, while the other of the first and second plates has a surface toward which the partition walls 18 extend from the above-indicated one plate.

The upper surface of the dielectric layer 26 on the back plate 14 and the side surfaces of the partition walls 18 are covered by fluorescent layers 28. The fluorescent layers 28 corresponding to three successive discharge chambers 16 correspond to the three colors R, G, B and the respective three rows of red-color, green-color and blue-color cells, respectively. The three successive fluorescent layers 28 have different thickness values selected within a range of about 10–50 μm, for example. For instance, the fluorescent layer 28 are formed by screen printing such that a paste including a fluorescent material is drooped along the side surfaces of the partition walls 18 down to the bottom surface of each discharge chamber 16. The fluorescent layers 28 corresponding to the three successive discharge chambers 16 include different fluorescent materials corresponding to the three colors R, G, B. As described below, the discharge chambers 16 are filled with an ionizable gas. The fluorescent materials of the fluorescent layers 28 emit visible light upon excitation thereof by a ultraviolet radiation emitted by the gas when a discharge occurs between the discharge electrodes 20*a*, 20*b* of a selected pair, in a plane parallel to the dielectric layer 22.

Figure 2:
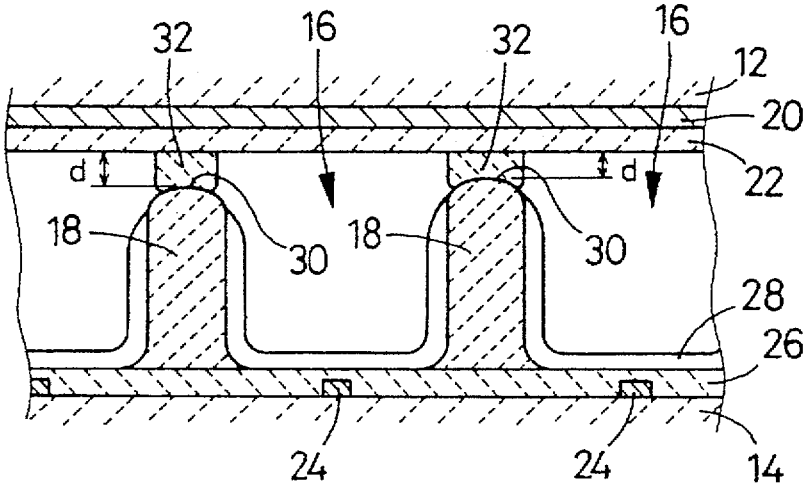
FIG. 2 is an enlarged elevational view in cross section showing details of partition walls formed in the display panel of FIG. 1.

The partition walls 18 are formed by a thick-film screen printing technique, using a paste of an insulating material which includes a glass having a relatively low softening point and a predetermined amount of a suitable filler such as alumina. Each partition wall 18 has an end face which is opposed to the dielectric layer 22 on the inner surface of the front plate 12 and which is not covered by the fluorescent layers 28. As shown in enlargement in FIG. 2, a height adjusting layer 32 is formed between the end face 30 of each partition wall 18 and the dielectric layer 22, such that the height adjusting layer 32 extends over the entire length of the partition wall 18. In the plasma display panel 10 as the end product, the thickness values of the height adjusting layers 32 are equal to respective distances "d" between the corresponding end faces 30 and the lower surface of the dielectric layer 22. Namely, the height adjusting layer 32 has a comparatively small thickness for the partition wall 18 which has a comparatively large height, and a comparatively large thickness for the partition wall 18 which has a comparatively small height. Thus, the total dimension (i.e., sum of the heights) of the partition wall 18 and the height adjusting layer 32 in the direction of height of the wall 18 is constant over the entire area of the plasma display panel 10 as seen in a plane parallel to the front and back plates 12, 14. In this respect, it will be understood that the partition wall 18 and the corresponding height adjusting layer 32 cooperate to constitute a constant height partition wall.

The height adjusting layers 32 are formed from a glass material having a relatively low softening point, in a manner as illustrated in FIGS. 3(*a*) through 3(*c*), by way of example only. In the interest of brevity and simplification, these figures do not show the discharge and address electrodes 20, 24, dielectric layers 22, 26 and fluorescent layers 28. Generally, these elements 20–28 including the dielectric layers 22, 26 are formed over almost entire areas of the front and back plates 12, 14, that is, not formed in outer peripheral portions of these plates 12, 14 at which a spacer glass member 34 and a frit sealing member 36 are disposed, as indicated in FIG. 3(*c*).

Initially, the partition walls 18 are formed on the back plate 14, as shown in FIG. 3(*a*)-1, by first forming shaped laminar masses of a paste of an insulating material by a thick-film screen printing process, and then firing the shaped laminar masses of the paste at a suitable temperature within a range between 500° C. and a point a few or several tens of degrees centigrade higher than 600° C. Then, a paste of a glass composition is applied to the end face 30 of each partition wall 18, by a thick-film forming process, whereby a shaped mass of the glass paste which gives the height adjusting layer 32 is formed on the end face 30 with suitable width "wo" and height or thickness "t", as also indicated in FIG. 3(*a*)-1. The glass composition for the height adjusting layers 32 may include a filler as used for the partition walls 18, and/or glass beads having a predetermined size, as needed, in addition to a glass which has a relatively low softening temperature. The addition of such filler and/or glass beads is effective to reduce an undesirable tendency of collapsing of the height adjusting layers 32 by their own weights, which results in gaps left between the dielectric layer 22 and the height adjusting layers 32 in the end product 10.

The amount of the glass paste to be applied for each height adjusting layer 32 is adjusted so that the height adjusting layer 32 is able to suitably fill a given volume between the dielectric layer 22 and the corresponding end face 30 in the plasma display panel 10 as the end product, as indicated in FIG. 3(*c*). Described in detail, the amount of the glass paste is determined so that the thickness "t" as indicated in FIG. 3(*a*) is sufficiently larger than an amount of variation in the height of the individual partition walls 18, that is, than a difference between the largest and smallest height values of the partition walls 18. Further, the thickness "t" and the printing width "wo" of the glass paste are determined so as to minimize the width "w" of the height adjusting layer 32 in the end product 10 as indicated in FIG. 3(*c*), that is, to prevent excessive drooping of the height adjusting layer 32 at the right and left edges of the end face 30 as seen in FIG. 3(*c*).

Reference is now made to the cross sectional view of FIG. 3(*a*)-2, taken in a plane parallel to the partition walls 18. As is apparent from this figure, the partition wall 18 has a variation in its height, in its longitudinal direction, and also has some burrs 33 which are left on its top face due to screen meshes of the thick-film screen printing. If it is desired that the height adjusting layers 32 function as black stripes for increased contrast of display images, a suitable black inorganic coloring agent is added to the glass paste. If the width dimensions "w" of the height adjusting layers 32 have a relatively large variation in the plasma display panel 10 as the end product, it is desirable to use a transparent or translucent glass paste for the height adjusting layers 32.

After the height adjusting layers 32 are formed on the respective partition walls 18 as described above, the spacer glass member 34 is placed on the back plate 14, so as to be positioned along the peripheral portion of the back plate 14, and the frit sealing member 36 is disposed adjacent to the outer surfaces of the spacer glass member 34, as shown in FIG. 3(*b*). The spacer glass member 34 has a suitably determined height (in the direction of height of the partition walls 18). In this condition, the front plate 12 is placed on an assembly of the back plate 14, partition walls 18, shaped masses of the glass paste for the height adjusting layers 32, spacer glass member 34 and frit sealing member 36, as also indicated in FIG. 3(*b*). The spacer glass member 34 is made of a glass whose softening point is high enough to prevent softening thereof at a heat treatment temperature in the next step of FIG. 3(*c*) in which the front and back plates 12, 14 are bonded together by the frit sealing member 36 via the spacer glass member 34, so as to define a fluid-tight space. On the other hand, the frit sealing member 36 is made of a glass material which has a softening point lower than that of the material of the partition walls 18, and which has a melting or fusing point at which the material of the height adjusting layers 32 is softened. Thus, of all the materials used for the plasma display panel 10, the glass material of the frit sealing member 36 has the lowest softening point, and the material of the height adjusting layers 32 has the next lowest softening point. The softening points of the materials of the other members (front and back plates 12, 14, partition walls 18, dielectric layers 22, 26, spacer glass member 34, etc.) are relatively high so that these members will not be softened at the heat treatment or sealing temperature in the next step.

The height of the spacer glass member 34 is determined to be slightly larger than the height of the highest or longest partition wall 18, while the height of the frit sealing member 36 is determined to be substantially equal or slightly larger than the height of the spacer glass member 34. Consequently, in the step of FIG. 3(*b*), the front plate 12 is supported by some of the shaped glass paste masses for the height adjusting layers 32 and/or the frit sealing member 36, and is spaced from the upper end of the spacer glass member 34. In the present specific example, the front plate 12 is supported by some of the shaped masses for the layers 32.

Then, the assembly of FIG. 3(*b*) is heated at a selected temperature, for example, at about 550° C., whereby the front and back plates 12, 14 are bonded together by the frit sealing member 36 via the spacer glass member 34 interposed therebetween, and the height adjusting layers 32 are formed between the end faces of the partition walls 18 and the inner surface of the front plate 12, as indicated in FIG. 3(*c*). As a result, the front and back plates 12, 14 and the members 34, 36 cooperate to define the fluid-tight space which is divided by the partition walls 18 (and the height adjusting layers 32) into the individual discharge chambers 16. The heat treatment or sealing temperature is determined so that the frit sealing member 36 is melted at the sealing temperature, but the shaped glass paste masses for the height adjusting layers 32 are softened but not melted. In FIGS. 3(*a*) through 3(*c*), the partition walls 18 are shown so as to exaggerate their height variation to some extent.

It will be understood that the height adjusting layer 32 on the comparatively long partition wall 18 such as the centrally located one shown in FIG. 3(*c*) has a comparatively small thickness "d", and a comparatively large width "w" which is larger than the initial or printing width "wo". On the other hand, the height adjusting layer 32 on the comparatively short partition wall 18 such as the rightmost one shown in FIG. 3(*c*) has a comparatively large height "d", and a comparatively small width "w" which is not so larger than the initial width "wo". For all the partition walls 18, therefore, the total heights of the partition wall 18 and the corresponding height adjusting layer 32 is substantially constant, owing to the adjustable nature of the height of the height adjusting layers 32, irrespective of a variation in the height of the individual partition walls 18. Further, the total height of each partition wall 18 and the corresponding height adjusting layer 32 is substantially constant in the longitudinal direction of the partition wall 18, as indicated by one-dot chain line in FIG. 3(*a*)-2, irrespective of a height variation of each partition wall 18 in the longitudinal direction. Since the heat treatment or sealing temperature is selected to be lower than the melting point of the height adjusting layers 32, the inner surface of the front plate 12 is simply in contact with the height adjusting layers 32, without bonding therebetween.

After the front and back plates 12, 14 and the spacer glass member 34 are bonded together at the peripheral portions of the plates 12, 14 by the frit sealing member 36 so as to form the fluid-tight space, the discharge chambers 16 are once evacuated and then filled or charged with a discharge gas such as He, Ne or Xe having a pressure of about 200–500 Torr (approximately 27–67 kPa). Thus, the AC-type color plasma display panel 10 is fabricated. In the illustrated embodiment, the front plate 12 is not bonded to the height adjusting layers 32. If gaps are left between the front plate 12 and the height adjusting layers 32 due to waviness, deflection, warpage or other deformation of the front plate 12 due to a change in the pressure in the fluid-tight space in the plasma displace panel 10 during the evacuation and gas filling of the discharge chambers 16, it is effective to include in the glass paste for the height adjusting layers 32 a suitable glass component which has a relatively low softening point and which is partially melted at the sealing temperature and bonded to the front plate 12.

In operation of the AC-type color plasma display panel 10 constructed as described above, suitably determined voltages are applied to the discharge electrodes 20 and the address electrodes 24, in a cyclic manner, as well known in the art. For example, each cycle consists of four phases: a first phase in which a positive voltage is applied to all of the address electrodes 24 while zero and positive voltages are applied to the respective discharge electrodes 20*a*, 20*b* of all pairs; a second phase in which zero voltage is applied to all of the address electrodes 24 and the discharge electrodes 20 of all pairs; a third phase in which a positive voltage is applied to selected ones of the address electrodes 24 while a positive voltage and a negative voltage are applied to the respective discharge electrodes 20*a*, 20*b* of selected pairs, so as to cause a momentary discharge in each of selected ones of the color cells, in a direction parallel to the dielectric layer 22; and a fourth phase in which an AC pulse is applied to all of the color cells, so that visible light is emitted for a relatively long time by the fluorescent material excited by ultraviolet radiations generated in the selected color cells which have been electrically charged by the momentary discharge. The color cells are selected by image signals received from an external device. Thus, the desired images such as letters, symbols, other characters and graphical representations are formed by the visible light emitted in the selected color cells.

In the present embodiment of the invention, the height adjusting layers 32 which have a softening point higher than that of the frit sealing member 36 and which are melted at the heat treatment or sealing temperature are interposed between the front plate 12 provided with the dielectric layer 22 and the end faces of the partition walls 18. The thickness of each height adjusting layer 32 is changed depending upon a squeezing force applied between the front plate 12 and the partition walls 18 during bonding of the front and back plates 12, 14 at the bonding or sealing temperature. Usually, the squeezing force is produced by the weight of the front plate 12 only. However, a relatively small force may be positively applied between the two plates 12, 14, by suitable means. The squeezing force increases with a decrease in the distance "d" between the front plate 12 and the end face 30 of the partition wall 18, and decreases with an increase in the distance "d". This distance "d" varies due to a height variation of each partition wall 18 and the individual partition walls 18, and warpage or waviness of the front plate 12. Since the height adjusting layers 32 are formed of a material whose softening point is higher than that of the frit sealing member 36, the layers 32 are softened but not melted or fused at the melting temperature of the frit sealing member 36, namely, at the sealing temperature at which the front and back plates 12, 14 are bonded together by the sealing member 36. Consequently, the thickness of each height adjusting layer 32 is determined or influenced solely by the squeezing force indicated above.

As is apparent from the above explanation, the height adjusting layers 32 function to prevent the presence of gaps between the end faces 30 of the partition walls 18 and the front plate 12 (more precisely, the dielectric layer 22). In other words, there are left no gaps between the end faces 30 and the height adjusting layers 32, and between the height adjusting layers 32 and the front plate 12. The provision of the height adjusting layers 32 assures complete gas-tight separation of the discharge chambers 16 from each other, without gaps between the end faces 30 of the partition walls 18 and the front plate 12, which would otherwise be present due to a height variation of the partition walls 18 and poor flatness or straightness of the front plate 12. Further, the provision of the height adjusting layers 32 does not significantly complicate the fabrication process of the plasma display panel 10.

Further, the provision of the height adjusting layers 32 for compensation for the height variation of the partition walls 18 favorably reduces the requirements for stringent shape retention and accurate thickness control of the shaped laminar masses of the paste for the partition walls 18 by thick-film screen printing, thereby permitting a higher degree of freedom in material selection and process step parameters (e.g., number of repeated screen printing operations) of the partition walls 18. In addition, the height adjusting layers 32 assures high gas tightness between the partition walls 18 and the front plate 12 even where the color plasma display panel 10 has a large display screen.

Figure 4:
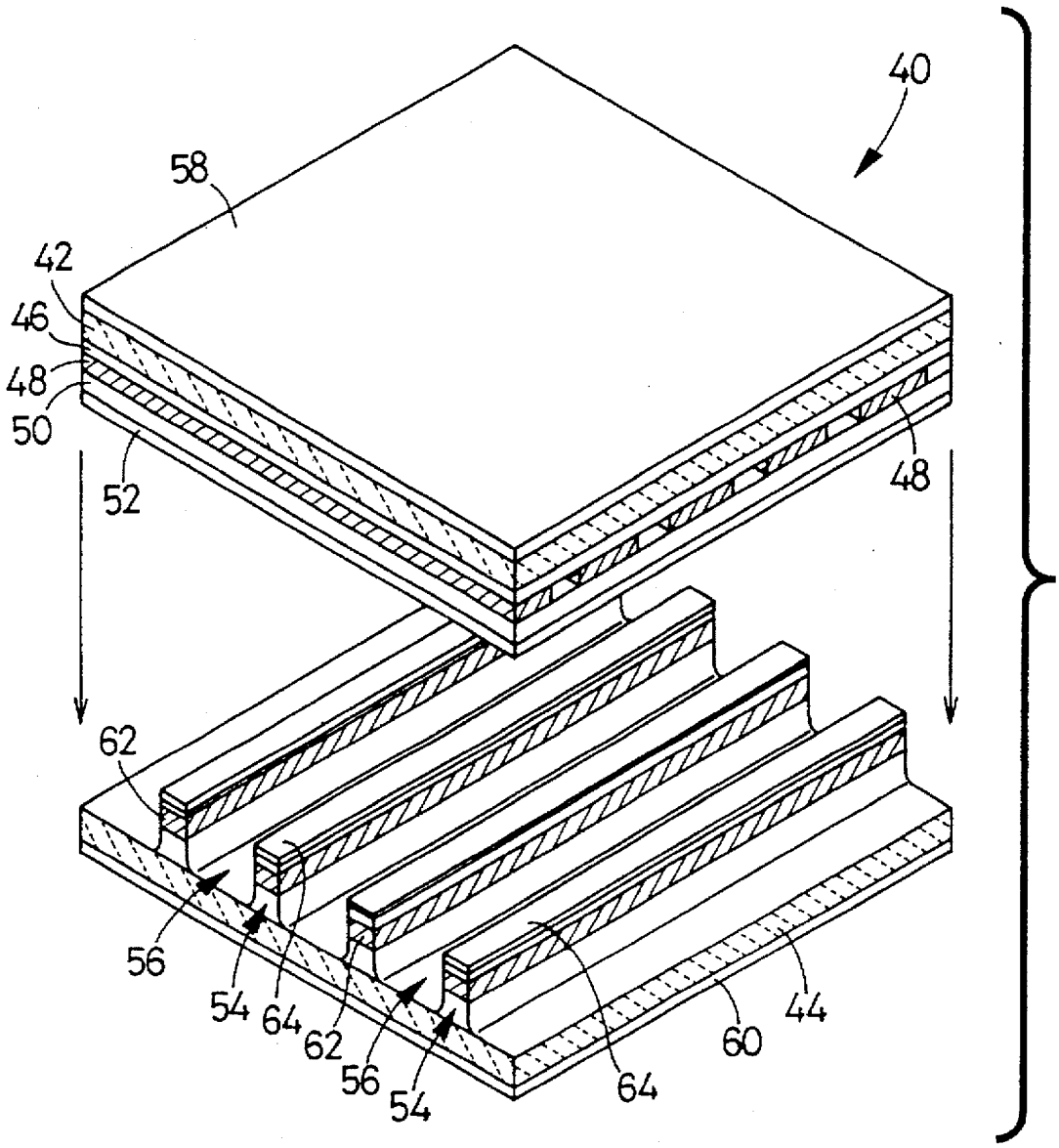
FIG. 4 is a perspective view illustrating another embodiment of the invention in the form of a color plasma address liquid crystal display panel.

Referring next to the perspective view of FIG. 4, there is shown a color plasma address liquid crystal display panel (PALC) 40 constructed according to another embodiment of this invention, including a front plate 42 and a back plate 44 which are shown separately from each other. The front plate 42 is a transparent glass plate. This color plasma address liquid crystal display panel 40 further includes a color filter 46, transparent electrodes 48 and a thin glass plate 52, which are provided in the order of description on one of the opposite major surfaces of the transparent front plate 42 such that a liquid crystal layer 50 is formed between the transparent electrodes 48 and the thin glass plate 52. On one major surface of the back plate 44 which is also a transparent glass plate, there are formed a plurality of parallel partition walls 54. The thin glass plate 52 and the back plate 44 are gas-tightly bonded together at their peripheral portions, thereby defining a fluid-tight space which is divided by the partition walls 54 into a plurality of elongate parallel discharge chambers 56 filled with a rare gas. On the other or outer major surfaces of the front and back plates 42, 44, there are formed respective deflector plates 58, 60. In the present embodiment, the thin glass plate 52 and the back plate 44 serve as one and the other of the first and second plates, respectively.

Each of the partition walls 54 formed on the back plate 44 has a width of a few or several tens of microns to about 200 μm, and a height of about 100–300 μm. The partition walls 54 are formed in parallel such that a center-to-center distance between the adjacent partition walls 54 as measured in their longitudinal direction is about 600 μm, and defines a pitch of the picture elements of the color plasma address liquid crystal display panel 40. Each partition wall 54 includes a similarly elongate discharge electrode 62 as an integral intermediate portion thereof having a thickness of a few or several tens of microns. The lower end of the discharge electrode 62 is spaced from the inner surface of the back plate 44 by a distance not larger than a few or several tens of microns.

The partition walls 54 are formed by a thick-film screen printing technique, using a paste of an insulating material including a glass having a relatively low softening point and a suitable filler, in a manner as described above with respect to the partition walls 18 in the first embodiment. As in the plasma display panel 10, a height adjusting layer 64 is formed on the end face of each partition wall 54. Like the height adjusting layers 32, shaped masses of the glass paste which give the height adjusting layers 64 are formed on the end faces of the partition walls 54, by thick-film screen printing using a paste of a glass material whose softening point is lower than that of the glass material of the partition walls 54. In the present embodiment, too, the total height of the partition wall 54 and the height adjusting layer 64 is substantially constant over the entire area of the display panel 40.

In the process of forming each partition wall 54, the discharge electrode 62 is formed by thick-film screen printing using a paste of an electrically conductive material such as Ni, Al or a metal oxide so that the fired electrode 62 has a thickness of a few or several microns. The electrically conductive paste is applied to the previously applied paste for the lower portion of the partition wall 54, so that the upper end of the lower portion of the fired partition wall 54 (i.e., the lower end of the fired electrode 62) is spaced from the back plate 44 by a distance of 5 μm to a few or several tens of microns, as indicated above. After the electrically conductive paste for the discharge electrode 62 is applied, the paste for the upper portion of the partition wall 54 is applied by screen printing to the electrically conductive paste. Then, the thus applied glass paste masses for the partition walls 54 and discharge electrodes 62 are fired at a suitable temperature within a range between 500° C. and a point a few or several tens of degrees centigrade higher than 600° C. Thus, the partition walls 54 each including the discharge electrode 62 as an intermediate portion thereof are formed on the back plate 44.

The color filter 46 provided on the front plate 42 has a plurality of parallel strips of coloring materials or pigments corresponding to the three primary colors R (red), G (green) and B (blue). The strips extend in a direction perpendicular to the direction of extension of the partition walls 54, and are equally spaced apart from each other such that a center-to-center distance between the adjacent strips is in the neighborhood of 200 μm. These strips of coloring materials or pigments are formed by pigment dispersing technique, electrocoating technique, printing technique or other technique known in the art. In a similar manner, a plurality of non-light-transmitting black stripes are formed each stripe between the adjacent strips of pigments. The three successive strips of the coloring matters for the three colors R, G and B correspond to one picture element which has a size of about 600 μm.

The transparent electrodes 48 consist of a plurality of parallel strips of a conductive material such as indium oxide or tin oxide (ITO electrode material), which strips are aligned with and located just above the respective strips of the coloring materials of the color filter 46. These conductive strips of the transparent electrodes 48 have substantially the same dimensions as the strips of the coloring materials. To form the conductive strips, a layer of the conductive material is first formed over the entire surface of the color filter 46 by vapor deposition or sputtering, and this conductive layer is patterned into the conductive strips by photolithography, for example.

The liquid crystal layer 50 consists of a liquid crystal material injected into a space between the transparent electrodes 48 and the thin glass plate 52. The thin glass plate 52 has a thickness of about 50 μm, for example, and is bonded to the front plate 42 by an organic binder. As described below, the thin glass plate 52 functions to store an electric charge, and partially define a fluid-tight space filled with a rare gas. Thus, the thin glass plate 52 functions as a dielectric layer in the present embodiment.

To fabricate the color plasma address liquid crystal display panel 40, the thin glass plate 52 and the back plate 44 are first bonded together at a suitable heat treatment or sealing temperature, by the spacer glass member 34 and frit sealing member 36, as indicated in FIG. 3(*c*). Then, the thin glass plate 52 and the front plate 42 with the transparent electrodes 48 and other components are bonded together by a glass having a relatively low softening point. Subsequently, the discharge chambers 56 are filled with a rare gas such as Ne having a pressure of a few or several hundreds of Torr (a few or several tens of kPa). In the present embodiment, too, the frit sealing member 36 consists of a material which has a softening point lower than that of the height adjusting layers 64, and a melting point at which the height adjusting layers 64 are softened.

In operation of the color plasma address liquid crystal display panel 40, the discharge chambers 56 are successively scanned such that a discharge voltage of about −200V is applied between the adjacent discharge electrodes 62, 62, so as to induce electric discharge and to generate plasma sequentially in the discharge chambers 56. In timed response to the scanning of the discharge chambers 56, the above voltage is applied to the conductive strips of the transparent electrodes 48 corresponding to the strips of the coloring materials of the color filter 46 which transmit a back light. Thus, the segments of the strips of the coloring materials of the color filter 46 which correspond to the currently activated discharge chambers 56 are sequentially addressed, and the back light is continuously transmitted through the selected local spots of the color filter 46, owing to a stored electric charge in the selected discharge chambers 56, whereby desired images such as letters and symbols are displayed. It is noted that the transmission of the back light through the local spots of the color filter 46 is maintained as long as the electric charge is maintained, and this memory effect is reset in the next scanning cycle. For example, each scanning cycle of the discharge chambers 56 is effected with an addressing time of about 6–40 μs for each discharge chamber 56.

Described more specifically, when the above-indicated discharge voltage is applied between the two discharge electrodes 62, 62 which are exposed to a certain discharge chamber 56, an electrical discharge occurs and plasma is generated in that discharge chamber 56, whereby an electrical potential is substantially uniformly established over substantially the entire area in the discharge chamber 56, except a portion near one of the two discharge electrodes 62, 62 which functions as a display electrode. Upon application of the above voltage to a selected conductive strip of the transparent electrodes 48 on the front plate 42 in the presence of the plasma in the discharge chamber 56, an electric charge is accumulated and stored at a surface area of the thin glass plate 52 exposed to the discharge chamber 56, based on a difference in the electric potential between the above-indicated surface area of the thin glass plate 52 and the conductive strip of the transparent electrode 48. As a result of this charging of a local portion of the discharge chamber 56, the molecules in a local portion of the liquid crystal layer 50 just above the charged local portion of the discharge chamber 56 are orderly arranged or oriented. Thus, the back light incident upon the back plate 44 is transmitted through a local segment of the color filter 46 which corresponds to an intersection between the activated discharge chamber 56 and the conductive strip of the transparent electrode 48. The back light transmitted through the color filter 46 is emitted from the outer surface of the front plate 42 through the deflector plate 58. The orderly orientation of the molecules of the liquid crystal layer 50 is retained by the stored electric charge even after the plasma generated in the discharge chamber 56 has disappeared. This memory effect permits a continued display of a clear bright image.

In the present second embodiment of FIG. 4, the height adjusting layers 64 formed of a material whose softening point is higher than that of the frit sealing member 36 and which is softened at the sealing temperature is interposed between the thin glass plate 52 and the respective partition walls 54. In the sealing step in which the thin glass plate 52 and the back plate 44 are bonded together, the height adjusting layers 64 are softened and deformed by squeezing forces between the thin glass plate 52 and the end faces of the partition walls 54, which squeezing forces vary due to the height variation of the partition walls 54 and other factors. The thus deformed height adjusting layers 64 having different thickness or height dimensions fill the spaces between the partition walls 54 and the thin glass plate 52, without gaps left therebetween, whereby the individual discharge chambers 56 are gas-tightly separated from each other, as in the AC-type plasma display panel 10 of the first embodiment.

The thickness or height dimensions of the height adjusting layers 64 change depending upon the squeezing forces acting thereon in the heat treatment or sealing step. Namely, the thickness of the height adjusting layer 64 is comparatively small if the squeezing force is comparatively large, that is, if the layer 64 is applied to the comparatively long partition wall 54. Conversely, the thickness of the layer 64 is comparatively large if the squeezing force is comparatively small, that is, if the layer 64 is applied to the comparatively short partition wall 54. Accordingly, the total height of the partition wall 56 and the height adjusting layer 64 is constant over the entire area of the thin glass plate 52, whereby the flatness of the thin glass plate 52 is improved even if its thickness is relatively small in the present display panel 40. This results in reduced variation in the thickness of the liquid crystal layer 50, and enhanced uniformity of display.

In the present embodiment, too, the provision of the height adjusting layers 64 for compensation for the height variation of the partition walls 54 favorably reduces the requirements for stringent shape retention and accurate thickness control of the laminar green layers in forming the partition walls 54 by thick-film screen printing, thereby permitting a higher degree of freedom in material selection and process step parameters (e.g., number of the laminar green layers formed by repeated screen printing operations) of the partition walls 54. In addition, the height adjusting layers 64 assures high gas tightness between the partition walls 54 and the thin glass plate 52 even where the color plasma address liquid crystal display panel 40 has a large display screen.

Figure 5:
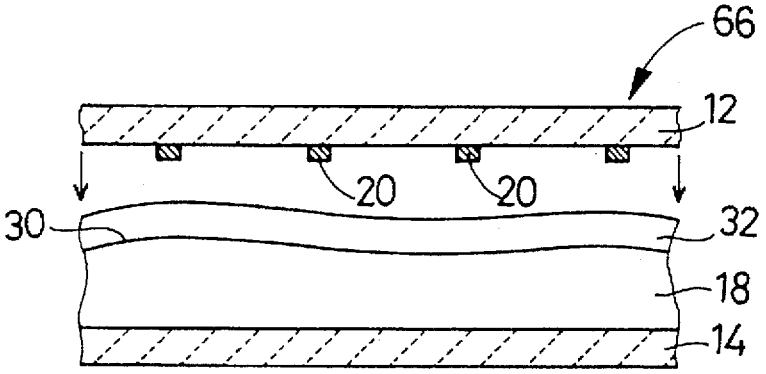
FIGS. 5(*a*) and 5(*b*) are fragmentary elevational views in cross section showing a partition wall and adjacent components of a DC-type plasma display panel constructed according to a further embodiment of this invention, FIG. 5(*a*) showing a front and a back plate before bonding thereof, while FIG. 5(*b*) showing these plates after the bonding.
Figure 5:
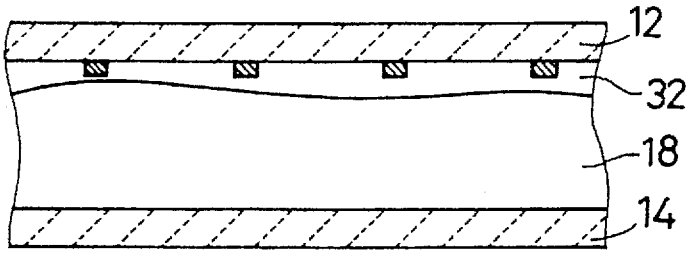

Referring to FIGS. 5(*a*) and 5(*b*), there is shown a DC-type plasma display panel 66 in cross section taken in a plane parallel to the partition walls 18. FIG. 5(*a*) shows the front and back plates 12, 14 prior to bonding thereof, while FIG. 5(*b*) shows these plates 12, 14 which have been bonded together. As in the AC-type plasma display panel 10 of FIGS. 1–3, the height adjusting layers 32 are formed on the end faces 30 of the respective partition walls 18. The material of the height adjusting layers 32 has a softening point lower than that of the partition walls 18 and higher than that of the frit sealing member 36, and is softened at the sealing or heat treatment temperature at which the front and back plates 12, 14 are bonded together.

In the present DC-type plasma display panel (PDP) 66, the discharge or display electrodes 20 and the address electrodes 24 (as indicated in FIG. 1) are exposed to the discharge chambers 16. That is, the display electrodes 20 are formed on the inner surface of the front plate 12 which partially defines the discharge chambers 16, as indicated in FIG. 5(*b*). In fabricating the present display panel 66, too, the front and back plates 12, 14 are bonded together in the process as indicated in FIGS. 3(*a*) through 3(*c*), wherein the height adjusting layers 32 are deformed by squeezing forces which depend upon not only a height variation of the partition walls 18 and warpage or waviness of the front plate 12, but also the presence of the exposed display electrodes 20.

In the present third embodiment, too, the gaps otherwise left between the partition walls 18 and the front plate 12 are filled by the height adjusting layers 32, and the individual discharge chambers 16 are gas-tightly separated from each other by the partition walls 18 and height adjusting layers 32.

In the conventional DC-type plasma display panel, on the other hand, the partition walls directly contact the display electrodes formed on the inner surface of the front plate, and there are left gaps between the partition walls 18 and the front plate 12, even if the partition walls have the same height and the front plate has a comparatively high degree of flatness. The size of these gaps in the direction of extension of the partition walls is equal to the thickness of the display electrodes. Thus, the conventional DC-type plasma display panel suffers from incomplete gas tightness between the adjacent discharge chambers 16.

Figure 6:
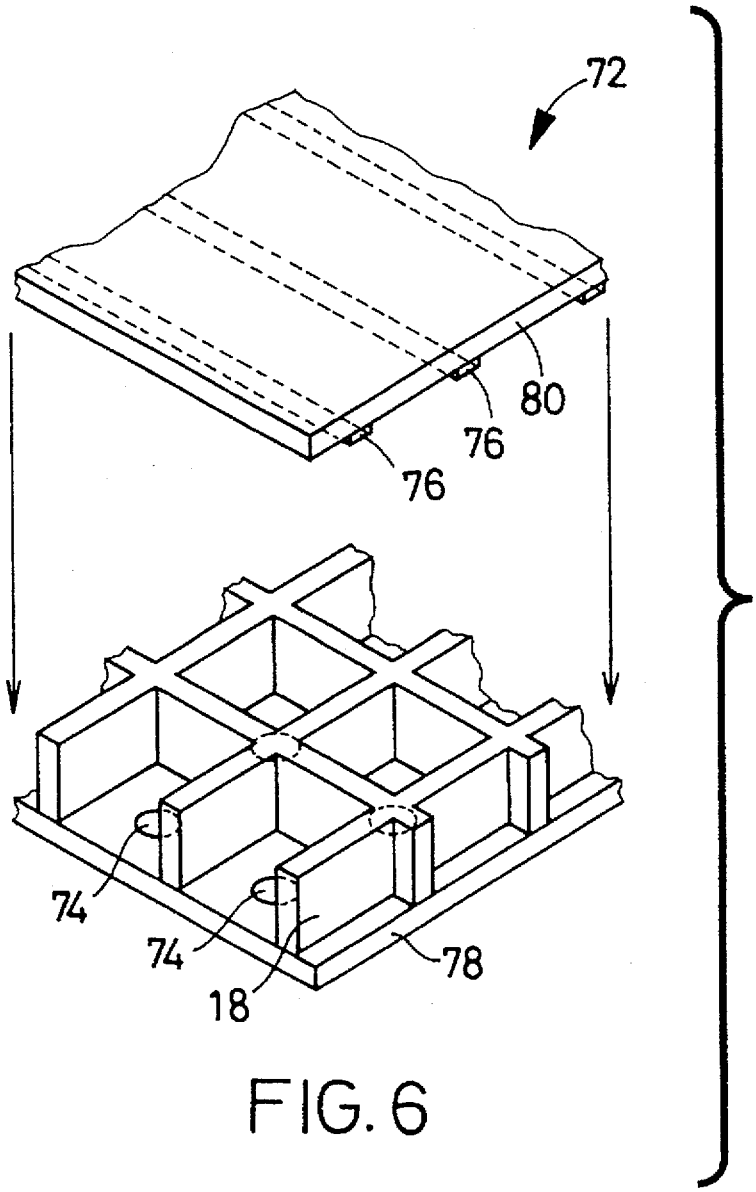
FIG. 6 is a fragmentary perspective view showing a construction of a pulse memory DC-type plasma display panel to which the present invention is applicable.

Reference is now made to FIG. 6 showing a pulse memory DC-type plasma display panel (PDP) 72, wherein anodes 74 are formed on a back plate 78 while cathodes 76 are formed on a front plate 80. To assure uniform electric discharge in the discharge chambers, the gaps between the anodes 74 and the cathodes 76 should be made constant. To this end, the back and front plates 78, 80 should be gas-tightly bonded together such that the anodes 74 and cathodes 76 on the back and front plates 78, 80 are accurately positioned relative to each other. The back and front plates 78, 80 are positioned relative to each other and held in their nominal relative positions by suitable means such as clamps or weights before their bonding. However, the positioned back and front plates 78, 80 may be dislocated from their nominal relative positions due to softening or melting of the frit sealing member 36 when the plates 78, 80 are subsequently bonded together by the frit sealing member 36. This dislocation may cause a variation in the gaps between the anodes 74 and the cathodes 76, which prevents uniform electrical discharge over the entire area of the plasma display panel 72. The application of the height adjusting layers 32 to the end faces of the partition walls 18 according to the present invention is effective to prevent the otherwise possible dislocation of the back and front plates 78, 80, because the layers 32 in close contact with the cathodes 76 provide a resistance to movements of the back and front plates 78, 80 relative to each other in a plane parallel to the plates 78, 80. In the present color plasma display panel 72, too, fluorescent layers including fluorescent materials corresponding to the three primary colors are formed so as to cover the side surfaces of the partition walls 18 and the upper surfaces of the back plate 78 except the areas on which the anodes 74 are formed.

Figure 7:
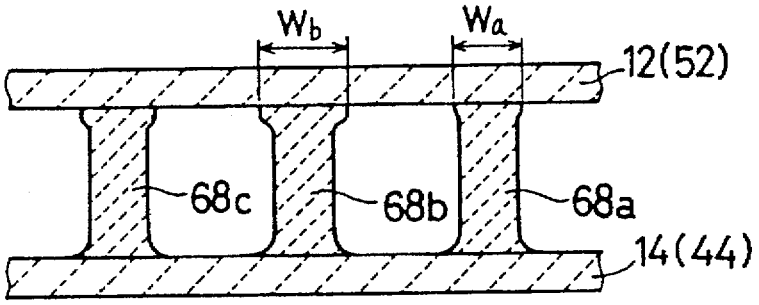
FIG. 7 is an elevational view in cross section of a still further embodiment of the invention.

Referring to FIG. 7, there are shown a plasma display panel according a further embodiment of this invention wherein reference numerals 68*a*, 68*b*, 68*c* denote partition walls which cooperate with first and second plates 12 (52) and 14 (44) to define discharge chambers. In the present embodiment, too, the first plate (front plate 12 or thin glass plate 52) and the second plate (back plate 14, 44) are bonded together via the spacer glass member 34 by the frit sealing member 36, as shown in FIG. 3(*c*). The partition walls 68 are formed from a material similar to that of the height adjusting layers 32, 64, namely, a material which has a softening point higher than that of the frit sealing member 36 and which is softened at the melting point of the frit sealing member 36. Thus, the softening point of the partition walls 68 is higher than that of the frit sealing member 36, but is lower than those of the first and second plates 12 (52), 14 (44). It is noted that the spacer glass member 34 and the frit sealing member 36 in the present embodiment prior to the sealing step have the same height relationship as explained with respect to the color plasma display panel 10. However, the height of the spacer glass plate 34 should be smaller than the height of the shortest partition wall 68, prior to the sealing step.

Upon bonding of the first and second plates 12 (52), 14 (44), the partition walls 68 are softened, and are deformed by squeezing forces corresponding to their heights prior to the bonding. Namely, the partition walls 68 are deformed so as to have substantially the same height such that the amount of reduction of height of the partition walls 68 due to the deformation increases with the squeezing forces acting thereon. Thus, the partition walls 68 per se function so as to eliminate gaps between the deformed partition walls 68 and the first plate 12 (52), whereby the individual discharge chambers 16, 56 are gas-tightly separated from each other, as in the preceding embodiments in which the separate height adjusting layers 32, 64 are provided on the partition walls 18, 54. Further, the substantially equal heights of the deformed partition walls 68 assure improved flatness or straightness of the thin glass plate 52 and improved uniformity of thickness of the liquid crystal layer 50, even if the thickness of the glass plate 52 is comparatively small, as in the color plasma address liquid crystal display panel 40 of FIG. 4.

In the present embodiment, the partition wall 68*a* which has a comparatively small height before the bonding or sealing step undergoes a comparatively small amount of deformation and an accordingly small width "wa" at its upper end portion. On the other hand, the partition wall 68*b* which has a comparatively large height before the sealing step undergoes a comparatively large amount of deformation and an accordingly large width "wb" at its upper end portion. It is noted, however, that the width difference of these partition walls 68*a*, 68*b* as shown in FIG. 7 is exaggerated for easy understanding, and that the actual width difference is not so large since the original height variation of the partition walls 68 is not so large, and the amounts of deformation of the partition walls 68 so as to compensate for the height variation are not so different. Therefore, the variation of the width "w" of the deformed partition walls 68 is accordingly small and does not cause a considerable difference in the light-transmitting areas of the individual discharge chambers 16 (56) at the first plate 12 (52). Rather, the difference in the light-transmitting areas is made smaller in the present embodiment in which the entirety of the partition walls 68 function to absorb the height variation. Where the upper end portions of the partition walls 68 are assigned to serve as the light-shielding back stripes, the present embodiment is advantageous in the display uniformity over the embodiments of FIGS. 1 and 4 in which the height adjusting layers 32 are formed on the partition walls 18, 54. That is, the compensation for the height variation of the partition walls 18, 54 by the height adjusting layers 32 requires relatively large amounts of deformation of the height adjusting layers 32 in the direction perpendicular to the partition walls, and results in a relatively large difference or variation in the light-transmitting areas of the discharge chambers.

To form the partition walls 68, thick-film screen printing operations are repeated so as to form laminar stacks of green layers in a predetermined pattern, using a paste of an insulating material which includes a glass having a softening point sufficiently lower than that of the first plate 12 (52), and suitable filler and organic binder. The thus formed stacks of green layers are fired at a predetermined temperature into the partition walls 68. Generally, partition walls 68 are formed using a glass material whose softening point is comparatively high and using a comparatively large amount of a filler, in order to prevent deformation of the partition walls upon firing thereof and upon sealing of the first and second plates. However, the present embodiment uses a glass material whose softening point is comparatively low, and a comparatively small amount (e.g., about 10–50 wt. %) of a filler, so that the material of the partition walls is softened at the predetermined sealing temperature.

The entirety of each partition wall 68 need not be formed of the same insulating paste. For example, different insulating pastes may be used depending upon different height portions of the partition wall 68, so that the softening point of the insulating pastes decreases in the direction from the bottom toward the top of the partition wall, or only the upper end portion of the partition wall has a sufficiently low softening point. In such cases, the lower end portion of the partition wall 68 may not be softened in the sealing step. However, the softening of only the upper end portion of the partition wall 68 does not matter. In other words, the softening of the portion of the partition wall above the upper end of the spacer glass member 34 is sufficient to prevent gaps left between the upper end of the partition wall 68 and the lower surface of the first plate 12 (52). The principle of the present invention may be satisfied as long as at least the upper end portion of the paste mass of the partition wall is formed of a paste which is softened at the sealing temperature.

Figure 8:
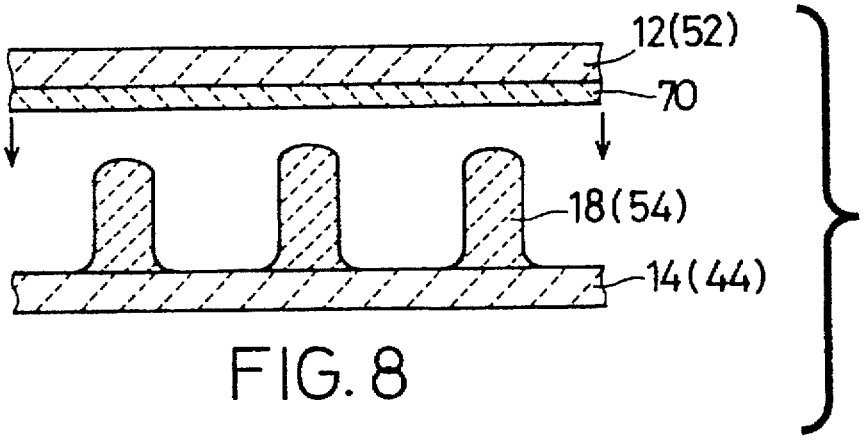
FIG. 8 is an elevational view in cross section of a yet further embodiment of the invention.

Referring next to FIG. 8, there will be described a still further embodiment of this invention, wherein a single height adjusting layer 70 is formed on the entire area of the inner surface of the first plate 12 (52) which faces the second plate 14 (44). In this arrangement, too, the height variations of the partition walls 18, 54 may be compensated for by thickness change or adjustment of the height adjusting layer 70 by different squeezing forces which act between the first plate 12 (52) and the local areas of the layer 70, whereby the layer 70 serves to prevent gaps between the partition walls 18, 54 and the first plate 12 (52). While the single height adjusting layer 70 is formed so as to cover the entire surface area of the first plate 12 (52), respective height adjusting layers may be formed on the first plate 12 (52), as elongate strips corresponding to the individual partition walls 18.

In the embodiment of FIG. 8, local areas of the height adjusting layer 70 which are aligned with the partition walls 18 (54) may be considered to provide a plurality of height adjusting layers interposed between the inner surface of the plate 12 (52) and the end faces of the partition walls 18 (54).

While the present invention has been described in detail in its presently preferred embodiments, it is to be understood that the invention is not limited to the details of the illustrated embodiments, but may be otherwise embodied.

Although the illustrated embodiments take the form of the AC-type color plasma display panel 10, color plasma address liquid crystal display panel 40 and DC-type plasma display panel 66, the principle of this invention is equally applicable to an AC-type monochromatic plasma display panel or plasma address liquid crystal display panel which is not provided with the fluorescent layers 28 or color filter 46, and to a DC-type color plasma display panel provided with fluorescent layers.

In the embodiments of FIGS. 1, 4, 5, 7 and 8, wherein the elongate parallel discharge chambers 16, 56 are defined by the elongate parallel partition walls 18, 54, a matrix of discharge chambers may be defined by a lattice of partition walls.

While the height adjusting layers 32 have a softening point higher than that of the frit sealing member 36, the softening point of the layers 32 may be substantially the same as that of the frit sealing member 36. In this case, however, it is desirable that the layers 32 include a suitable filler such as glass beads or alumina particles, to prevent deformation of the layers 32 by their own weight in the sealing step.

In the color plasma address liquid crystal display panel 40 of FIG. 4, the discharge electrodes 62 are formed between the lower and upper portions of the partition walls 54. However, the discharge electrodes 62 may be formed on the back plate 44 and the partition walls 54 are formed on the respective discharge electrodes 62. Alternatively, both of the partition walls 54 and the discharge electrodes 62 may be formed on the back plate 44 such that each partition wall 54 is positioned between the adjacent discharge electrodes 62. Similar arrangements are also possible in the plasma display panels 10, 66.

Although an insulating material is used for the height adjusting layers 32 in the illustrated embodiments, an electrically conductive material may be used for the height adjusting layers 32, for preventing undesirable charging of the partition walls 18.

While the spacer glass member 34 is used between the front and back plates 12, 14 which are bonded together by the frit sealing member 36, the spacer glass member 34 is not essential and may be eliminate.

It is to be understood that the present invention may be embodied with various other changes, modifications and improvements, which may occur to those skilled in the art, without departing from the spirit and scope of the invention defined in the following claims.

what is claimed is:

1. A discharge display device comprising:

a first plate and a second plate which are disposed in parallel with each other and are spaced apart from each other;

a sealing member which is disposed between peripheral portions of said first and second plates and which cooperates with said first and second plates to form a gas-tight space;

a plurality of partition walls formed by thick-film printing on an inner surface of one of said first and second plates, so as to define a plurality of discharge chambers in said gas-tight space; and a plurality of height adjusting layers which are interposed between end faces of said partition walls, respectively, and an inner surface of the other of said first and second plates, which inner surface is opposed to said inner surface of said one of said first and second plates, each of said height adjusting layers being formed from a material which has a softening point not lower than that of said sealing member and which is softened at a sealing temperature at which said first and second plates are bonded together by said sealing member so as to form said gas-tight space, said height adjusting layers having respective thickness values which increase with a distance between said end faces of said partition walls and said inner surface of said first and second plates, so that said height adjusting layers assure gas-tight separation of said discharge chambers from each other, without gaps being left between said end faces of said partition walls and said inner surface of said other of said first and second plates.

2. A discharge display device comprising:

a first plate and a second plate which are disposed in parallel with each other and are spaced apart from each other;

a sealing member which is disposed between peripheral portions of said first and second plates and which cooperates with said first and second plates to form a gas-tight space;

a plurality of partition walls formed on an inner surface of one of said first and second plates, so as to define a plurality of discharge chambers in said gas-tight space; and a plurality of height adjusting layers which are interposed between end faces of said partition walls, respectively, and an inner surface of the other of said first and second plates, which inner surface is opposed to said inner surface of said one of said first and second plates, each of said height adjusting layers being formed from a material which has a softening point not lower than that of said sealing member and which is softened at a sealing temperature at which said first and second plates are bonded together by said sealing member so as to form said gas-tight space, said height adjusting layers having respective thickness values which increase with a distance between said end faces of said partition walls and said inner surface of said first and second plates, so that said height adjusting layers assure gas-tight separation of said discharge chambers from each other, without gaps being left between said end faces of said partition walls and said inner surface of said other of said first and second plates, and wherein said first and second plates and said partition walls have softening points higher than that of said height adjusting layers.

3. A discharge display device comprising:

a first plate and a second plate which are disposed in parallel with each other and are spaced apart from each other;

a sealing member which is disposed between peripheral portions of said first and second plates and which cooperates with said first and second plates to form a gas-tight space;

a plurality of partition walls formed on an inner surface of one of said first and second plates, so as to define a plurality of discharge chambers in said gas-tight space;

a plurality of height adjusting layers which are interposed between end faces of said partition walls, respectively, and an inner surface of the other of said first and second plates, which inner surface is opposed to said inner surface of said one of said first and second plates, each of said height adjusting layers being formed from a material which has a softening point not lower than that of said sealing member and which is softened at a sealing temperature at which said first and second plates are bonded together by said sealing member so as to form said gas-tight space, said height adjusting layers having respective thickness values which increase with a distance between said end faces of said partition walls and said inner surface of said first and second plates, so that said height adjusting layers assure gas-tight separation of said discharge chambers from each other, without gaps being left between said end faces of said partition walls and said inner surface of said other of said first and second plates;

a plurality of elongate parallel discharge electrodes corresponding to said plurality of partition walls, respectively, each of said plurality of elongate parallel discharge electrodes being interposed between a lower and an upper portion of the corresponding one of said plurality of partition walls;

a third plate disposed on one of opposite sides of said other of said first and second plates, which is remote from said one of said first and second plates; and a plurality of elongate parallel transparent electrodes which are supported by said third plate and which extend in a direction perpendicular to a direction of extension of said plurality of elongate parallel discharge electrodes.

4. A process of fabricating a discharge display device comprising: (a) a first plate and a second plate which are disposed in parallel with each other and are spaced apart from each other; (b) a sealing member which is disposed between peripheral portions of said first and second plates and which cooperates with said first and second plates to form a gas-tight space; (c) a plurality of partition walls formed on an inner surface of one of said first and second plates, so as to define a plurality of discharge chambers in said gas-tight space; and (d) a plurality of height adjusting layers which are interposed between end faces of said partition walls, respectively, and an inner surface of the other of said fist and second plates, which inner surface is opposed to said inner surface of said one of said first and second plates, each of said height adjusting layers being formed from a material which has a softening point not lower than that of said sealing member and which is softened at a sealing temperature at which said first and second plates are bonded together by said sealing member so as to form said gas-tight space, said height adjusting layers having respective thickness values which increase with a distance between said end faces of said partition walls and said inner surface of said first and second plates, so that said height adjusting layers assure gas-tight separation of said discharge chambers from each other, without gaps being left between said end faces of said partition walls and said inner surface of said other of said first and second plates, said process comprising the steps of:

forming said plurality of partition walls on said inner surface of said one of said first and second plates;

forming masses of a paste of said material on said end faces of said partition walls, respectively;

placing said sealing member on said peripheral portion of said one of said first and second plates, such that said sealing member has a height larger than that of a highest one of said partition walls;

placing said other of said first and second plates on an assembly of said one plate, said partition walls, said sealing member and said masses of said paste, such that said outer plate is supported by at least one of said sealing member and said masses of said paste; and heat-treating said assembly and said other plate such that said sealing member is melted while said masses of said paste are softened, for thereby bonding together said first and second plates by said sealing member, and for permitting said masses of said paste to be deformed between said inner surface of said other plate and said end faces of said partition walls, so as to form said height adjusting layers, respectively.

5. A discharge display device according to claim 1, wherein said plurality of height adjusting layers are formed on the end faces of said partition walls, respectively.

6. A discharge display device according to claim 1, wherein said height adjusting layers consist of respective portions of a single layer which is formed from said material, on said inner surface of said other plate, said respective portions of said single layer being interposed between said end faces of said partition walls, respective, and and said inner surface of said other plate.

7. A process of fabricating a discharge display device as defined in claim 6, comprising the steps of:

forming said plurality of partition walls on said inner surface of said one of said first and second plates;

forming a layer of a paste of said material on said inner surface of said other of said first and second plates;

placing said sealing member on said peripheral portion of said one of said first and second plates, such that said sealing member has a height larger than that of a highest one of said partition walls;

placing said other plate with said layer of said paste on an assembly of said one plate, said partition walls and said sealing member, such that said layer of said paste is in contact with at least one of said sealing member and said end faces of said partition walls; and heat-treating said assembly and said other plate with said layer of said paste such that said sealing member is melted while said layer of said paste is softened, for thereby bonding together said first and second plates by said sealing member, and for permitting said layer of said paste to be deformed between said inner surface of said other plate and said end faces of said partition walls, so as to form said height adjusting layers, respectively.

8. A discharge display device according to claim 1, further including a spacer glass member disposed adjacent to said sealing member, said spacer glass member being formed from a material which is not softened at said sealing temperature.

9. A discharge display device according to claim 1, wherein said other of said first and second plates is provided with a first dielectric layer bonded to said inner surface thereof, and said one of said first and second plates is provided with a second dielectric layer bonded to said inner surface thereof, said discharge display device further comprising:

a plurality of elongate parallel discharge electrodes embedded in said first dielectric layer; and a plurality of elongate parallel address electrodes which are embedded in said second dielectric layer and which extend in a direction perpendicular to a direction of extension of said plurality of elongate parallel discharge electrodes.

10. A discharge display device according to claim 1, further comprising:

a plurality of elongate parallel discharge electrodes formed on said inner surface of said other of said first and second plates; and a plurality of elongate parallel address electrodes which are formed on said inner surface of said one of said first and second plates and which extend in a direction perpendicular to a direction of extension of said plurality of elongate parallel discharge electrodes.

11. A discharge display device according to claim 3, further comprising a liquid crystal layer formed between said other of said first and second plates and said plurality of elongate parallel transparent electrodes.

12. A discharge display device comprising:

a first plate and a second plate which are disposed in parallel with each other and are spaced apart from each other;

a sealing member which is disposed between peripheral portions of said first and second plates and which cooperates with said first and second plates to form a gas-tight space; and a plurality of partition walls formed on an inner surface of one of said first and second plates, so as to divide said gas-tight space into a plurality of discharge chambers, at least an end portion of each of said partition walls remote from said one of said first and second plates being formed from a material which has a softening point higher than that of said sealing member and which is softened at a sealing temperature at which said first and second plates are bonded together by said sealing member so as to form said gas-tight space, said partition walls assuring gas-tight separation of said discharge chambers from each other, without gaps being left between said end faces of said partition walls and said inner surface of said other of said first and second plates.

13. A discharge display device according to claim 12, wherein an entirety of said each partition wall is formed from said material.

14. A discharge display device according to claim 12, wherein said first and second plates have softening points higher than that of said upper portion of said each partition wall.

15. A process of fabricating a discharge display device as defined in claim 12, comprising the steps of:

forming masses of at least one paste on said inner surface of said one of said first and second plates, said masses of said paste giving said plurality of partition walls when said masses are heat-treated, said at least one paste including a paste of said material of which an end portion of each of said masses is formed;

placing said sealing member on said peripheral portion of said one of said first and second plates;

placing said other of said first and second plates on an assembly of said one plate, said masses of said at least one paste and said sealing member, such that said other plate is supported by at least one of said sealing member and said masses of said at least one paste; and heat-treating said assembly and said other plate such that said sealing member is melted while said end portion of said each mass which is formed of said paste of said material is softened, for thereby bonding together said first and second plates by said sealing member, and for permitting at least said end portion of said each mass to be deformed into said end portion of said each partition wall.

16. A process according to claim 15, wherein each of said masses which give said partition walls is entirely formed of said paste of said material.

* * * * *